US007049735B2

(12) United States Patent
Ohkubo et al.

(10) Patent No.: US 7,049,735 B2
(45) Date of Patent: May 23, 2006

(54) INCANDESCENT BULB AND INCANDESCENT BULB FILAMENT

(75) Inventors: Kazuaki Ohkubo, Takatsuki (JP); Mitsuhiko Kimoto, Nara (JP); Yuriko Kaneko, Nara (JP); Mika Sakaue, Hirakata (JP); Makoto Horiuchi, Sakurai (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/224,941

(22) Filed: Sep. 14, 2005

(65) Prior Publication Data

US 2006/0001344 A1 Jan. 5, 2006

Related U.S. Application Data

(63) Continuation of application No. PCT/JP2004/19174, filed on Dec. 22, 2004.

(30) Foreign Application Priority Data

Jan. 7, 2004 (JP) ..... 2004-001809

(51) Int. Cl.
*H01K 3/02* (2006.01)

(52) U.S. Cl. ..... 313/341; 313/578; 313/273

(58) Field of Classification Search ..... 313/578, 313/574, 631, 326, 341, 344
See application file for complete search history.

(56) References Cited

U.S. PATENT DOCUMENTS 4,144,473 A * 3/1979 Almer ..... 313/315
5,343,112 A * 8/1994 Wegmann et al. ..... 313/346 R

FOREIGN PATENT DOCUMENTS

| | | |
|---|---|---|
| EP | 0 140 330 | 5/1985 |
| JP | 60-95850 | 5/1985 |
| JP | 3-102701 | 4/1991 |
| JP | 4-368769 | 12/1992 |
| JP | 5-166496 | 7/1993 |
| JP | 6-349358 | 12/1994 |
| JP | 2002-015707 | 1/2002 |

* cited by examiner

*Primary Examiner*—Ashok Patel
(74) *Attorney, Agent, or Firm*—Wenderoth, Lind & Ponack, L.L.P.

(57) ABSTRACT

An incandescent bulb filament having a flat Light-emitting surface and high Lamp efficiency and an incandescent bulb using this filament are provided. This incandescent bulb filament is characterized in that it is a filament of ribbon shape placed on one plane, and it includes: spaced portions which are placed side by side with spaces; and connecting portions which connect the spaced portions electrically in series. Each spaced portion has a thickness that is one half the width of the spaced portion or more, and the space between at least one pair of adjacent spaced portions is less than five times the width of the spaced portion.

14 Claims, 15 Drawing Sheets

FIG. 14 - PRIOR ART
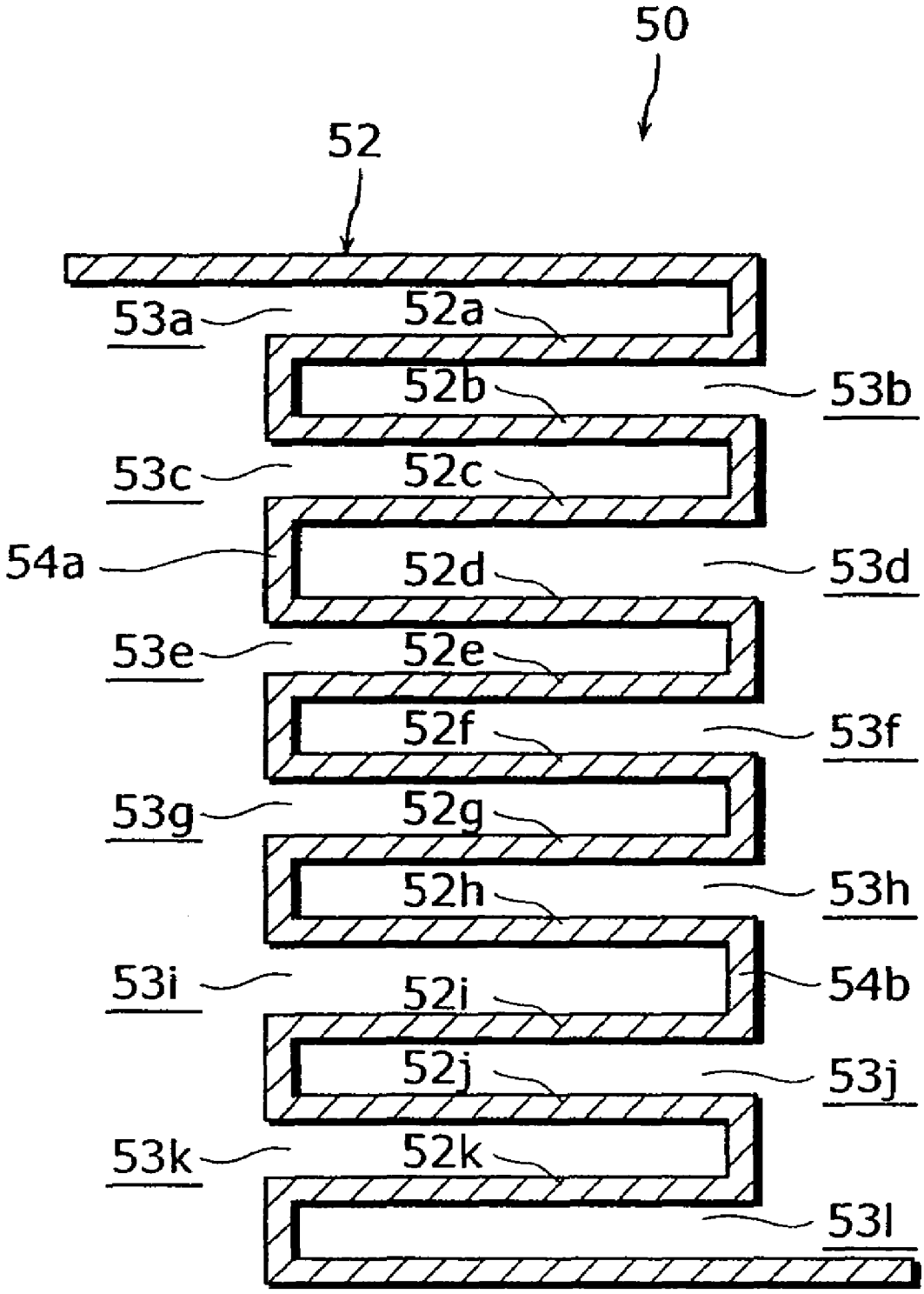

FIG. 15 - PRIOR ART
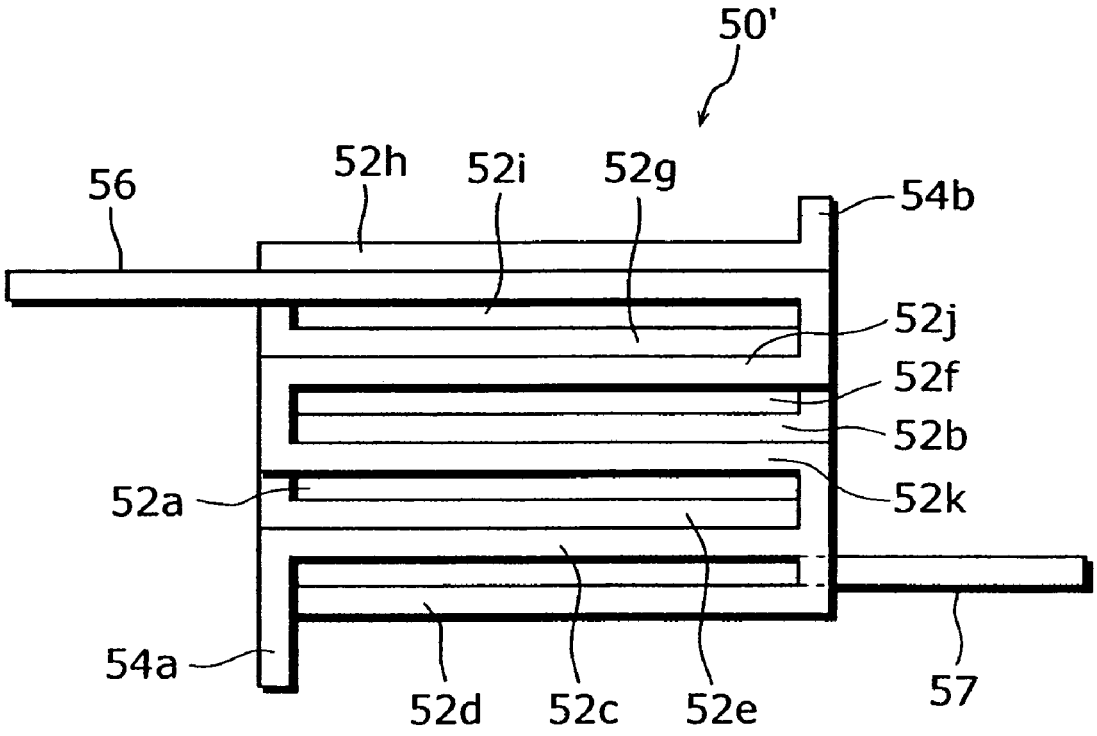

FIG. 16 - PRIOR ART
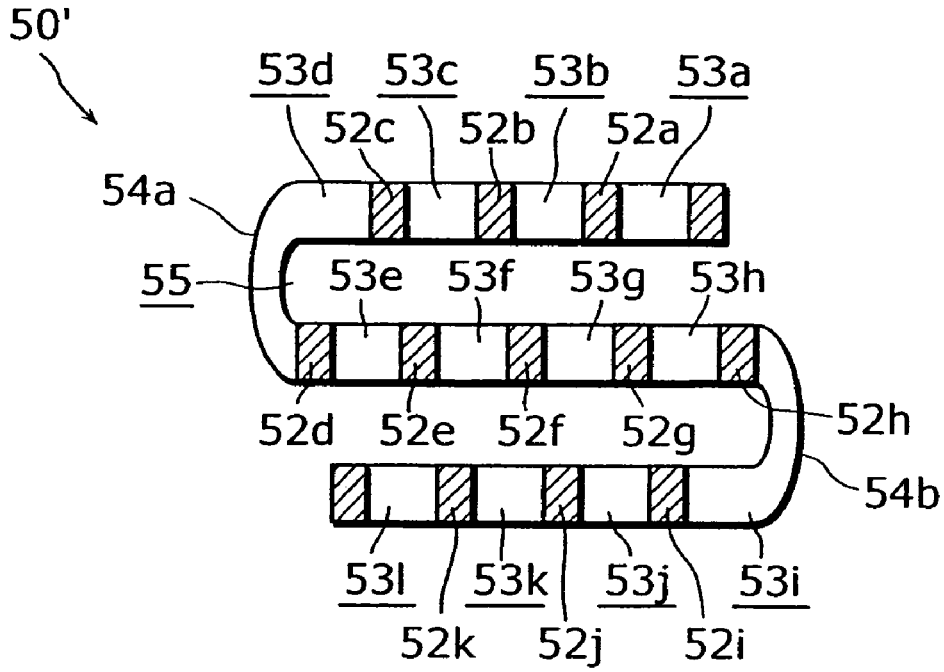

INCANDESCENT BULB AND INCANDESCENT BULB FILAMENT

CROSS REFERENCE TO RELATED APPLICATION

This is a continuation of PCT application No. PCT/JP2004/019174 filed on Dec. 22, 2004.

BACKGROUND OF THE INVENTION (1) Field of the Invention

The present invention relates to an incandescent bulb and an incandescent bulb filament, and particularly to an incandescent bulb filament of ribbon shape and an incandescent bulb using the filament.

(2) Description of the Related Art

A standard incandescent bulb includes a filament made of a conductive material, a bulb which envelops the filament, and a noble gas which is filled in the bulb, and has a high color rendering property. This incandescent bulb is widely used because it can be lighted using simple fixtures without using a lighting circuit such as a ballast, differently from a discharge lamp, and because it has a long history of use. (See, for example, Japanese Laid-Open Patent Application No. 3-102701 (Patent Document 1) and Japanese Laid-Open Patent Application No. 6-349358 (Patent Document 2)).

A filament is normally a coil made of a conductive wire, but Patent Document 2 discloses a filament made of a conductive ribbon. FIG. 14 shows a cross-sectional view of a filament 50 disclosed in Patent Document 2, and FIG. 15 shows a front view of a light-emitting element 50' disclosed in Patent Document 2, and FIG. 16 shows a cross-sectional view of the light-emitting element 50'. As shown in FIG. 14, the filament 50 is comprised of a molded element 52 made of a 250 μm-wide conductive ribbon, and the molded element 52 is comprised of a series of elements 52*a* to 52*k* which are alternately arranged in parallel with spaces 53*a* to 53I of integral multiples of the conductive ribbon width. It should be noted that the spaces 53*d* and 53*i* are larger than other spaces 53*a* to 53*c*, 53*e* to 53*h*, 53*j* and 53*k*. As shown in FIG. 15 and FIG. 16, the light-emitting element 50' is formed by making turns of the molded element 52 at connecting portions 54*a* and 54*b*. The front view of this light-emitting element 50' in FIG. 15 shows as if there is no space between the elements 52*a* to 52*k* of the molded element 52 because they are arranged so as to overlap above and below one another. However, the cross-sectional view of the light-emitting element 50' in FIG. 16 shows that an about 1 mm-wide space 55 is provided. The surface itself of the light-emitting element 50' is the light-emitting surface which is comprised of a series of elements 52*a* to 52*k*.

However, a standard incandescent bulb radiates electromagnetic waves including about 90 percent of infrared radiation and only about 10 percent of visible light. Such an incandescent bulb has low lamp efficiency of only about 13 Im/W, which poses a challenge to improvement in lamp efficiency. Here, lamp efficiency is defined as a ratio of an amount of light (luminous flux) to total energy generated per watt of power consumed by a lamp). Luminous flux is a measure of an amount of visible light propagated per unit time and is evaluated based on the sensitivity of a standard observer to the brightness of the light. Therefore, higher lamp efficiency means a larger amount of light generated per watt of consumed power, which provides energy savings.

A reflex lamp is a bulb having the inner surface, a part of which is coated with a reflective film. Visible light emitted from the filament in the backward direction of the lamp is reflected by the reflective film in the forward direction thereof so as to provide a higher illumination ahead of the lamp and has a higher lamp efficiency for the space which requires more brightness. However, even such a reflex lamp has far lower lamp efficiency than a fluorescent lamp, and therefore its lamp efficiency needs to be improved more.

In the light emitting element 50' described in Patent Document 2, each of the spaces 53*a* to 53*l* has the width of 500 μm that is the integral multiple of the width (250 μm) of the ribbon which forms the light-emitting element 50'. Each of the spaces 55 provided in the light-emitting element 50' has the width of 1 mm. In other words, there is a large space between the elements. Since a large space between the elements causes convection of a noble gas between the elements, a part of the heat generated in the light-emitting element 50' is lost. Therefore, the temperature of the surface of the light-emitting element 50' is not maintained constant across the board.

Generally speaking, envelopment of all over the surface of the filament (light-emitting element in Patent Document 2) by the heat generated in the filament allows the surface temperature to be maintained constant, and a bulb including such a filament has high lamp efficiency. In other words, a bulb including the light-emitting element 50' which does not allow its surface temperature to be maintained constant has low lamp efficiency. Therefore, it is also necessary to improve the lamp efficiency of the bulb including the light-emitting element 50' described in Patent Document 2.

SUMMARY OF THE INVENTION

The present invention has been conceived in view of the above problems, and it is an object of the present invention to provide an incandescent bulb of a simple structure which has high lamp efficiency and has surface light-emitting capability, and a filament for use with the incandescent bulb.

The incandescent bulb filament of the present invention is a filament of ribbon shape which is placed on one plane, including: spaced portions which are placed side by side with spaces; and connecting portions which connect the spaced portions electrically in series, wherein each of the spaced portions has a thickness that is one half a width of the spaced portion or more.

Here, "one plane" does not mean a plane in the strictly mathematical sense, but it means a substantial flat surface including a little distortion, deviation or twist created during filament working or bulb assembly. In other words, it means a substantial flat surface including a certain degree of distortion, deviation or twist that allows the heat generated by applying the current to the filament to form a heat sheath enveloping the filament so as to maintain the temperature of the filament at an acceptable level for commercial use.

It is preferable, in the incandescent bulb filament of the present invention, that a space between at least one pair of adjacent spaced portions is less than five times the width of the spaced portion, and that the width of the spaced portion is 100 μm or larger.

The incandescent bulb filament of the present invention may include microcavities on its surface.

It becomes possible, using these microcavities, to select arbitrary wavelengths for suppressing the radiation and thus to use the suppressed energy for visible light. Therefore, a filament of high lamp efficiency is provided.

Furthermore, in the incandescent bulb filament of the present invention, a first spaced portion may be placed so as to encircle a second spaced portion.

By such an arrangement of spaced portions, it becomes possible to retain the generated heat around the filament, that is, to form a so-called sheath efficiently, and therefore to improve the lamp efficiency.

Moreover, in the incandescent bulb filament of the present invention, a space between an outermost spaced portion and a spaced portion adjacent to the outermost spaced portion may be less than five times a width of the outermost spaced portion.

In the case where spaced portions are placed so that an outer spaced portion encircles an inner spaced portion sequentially, if only the space between the outermost spaced portion and the next inner spaced portion satisfies a predetermined condition, it becomes possible to place other inner spaced portions with arbitrary spaces between them.

The above-mentioned effects can also be achieved in an incandescent bulb including the incandescent bulb filament of the present invention.

As further information about technical background to this application, the disclosure of Japanese Patent Application No. 2004-001809 filed on Jan. 7, 2004 including specification, drawings and claims is incorporated herein by reference in its entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings:

FIG. 14 is a cross-sectional view of a filament in a conventional art;

FIG. 15 is a front view of a light-emitting element in the conventional art; and FIG. 16 is a cross-sectional view of the light-emitting element in the conventional art.

DESCRIPTION OF THE PREFERRED EMBODIMENT(S)

Figure 1:
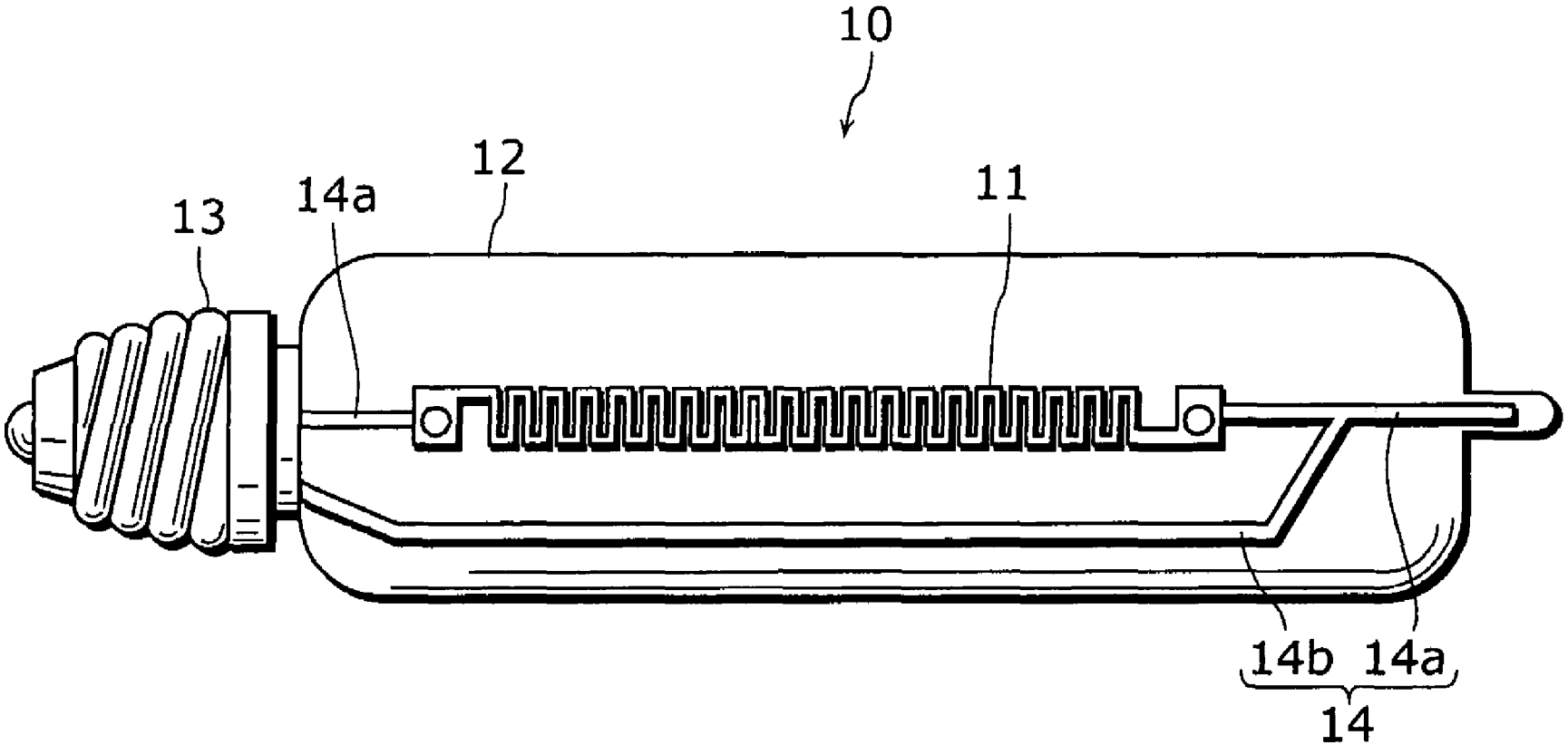
FIG. 1 is a side view of an incandescent bulb in a first embodiment.

Before describing the embodiments of the present invention, a description is given of a mechanism by which an incandescent bulb radiates electromagnetic waves.

An incandescent bulb includes a filament made of a conductive material such as tungsten, a bulb which envelops the filament, and a noble gas which is filled in the bulb.

If electrical power is applied to a filament made of a conductive material, it is converted to Joule heat in the filament and the filament temperature rises, and thermal oscillations take place in the molecules which comprise the conductive material and the atoms which comprises such molecules (hereinafter referred to as "conductive molecules"). Once the filament temperature reaches a certain level, the thermal energy charged in the conductive molecules are radiated as electromagnetic waves (thermal radiation), which results in lighting of the incandescent bulb. Therefore, the thermal oscillations in the conductive molecules become larger as the filament temperature rises, and as a result, a larger amount of thermal energy is radiated. The brightness of the lamp increases as the thermal energy radiation increases, and as a result, the lamp efficiency becomes higher. In other words, the lamp efficiency increases as the amount of current which passes through the filament increases. However, if the filament temperature becomes very high by applying a large amount of current to the filament, evaporation of the conductive molecules increases, which shortens the filament life. Therefore, an inert gas which does not react chemically with conductive molecules is filled in the bulb to decrease filament evaporation.

Furthermore, it is necessary to prevent the heat radiated from the filament (hereinafter referred to as "radiated heat") from diffusing in order to increase the lamp efficiency of the incandescent bulb. In a conventional lamp, a filament made of a tungsten wire coil is used to narrow the coil space between adjacent strands of the coil filament (hereinafter referred to as just "filament space") and therefore to prevent the radiated heat from diffusing. More specifically, the heat radiated from the coil filament forms a heat sheath (hereinafter referred to as a "sheath") which envelops all over the filament surface, which maintains the filament temperature constant. As a result, it becomes possible to reduce heat loss and therefore increase the lamp efficiency of the incandescent bulb.

However, when the filament space becomes too small, discharge takes place between the filament strands which are opposed to each other. When discharge takes place in a filament having a too small filament space, the impedance of the filament decreases and excessive current passes through the filament. As a result, the filament temperature becomes so high that the filament is broken. Once the filament is broken, the current does not pass through the whole filament and the incandescent bulb including such broken filament does not light up.

In contrast, when the filament space becomes too large like the light-emitting element 50' described in Patent Document 2 (it is referred to as "space" in Patent Document 2), convection of an inert gas such as a noble gas takes place between the filament strands. Therefore, the radiated heat is diffused by such gas convection, the filament temperature drops (or is not maintained constant) and therefore the lamp efficiency of the incandescent bulb decreases.

A description of the embodiments of the present invention is given below with reference to the diagrams. It should be noted that although only some exemplary embodiments of this invention are described in detail below, those skilled in the art will readily appreciate that many modifications are possible in the exemplary embodiments without materially departing from the novel teachings and advantages of this invention. Accordingly, all such modifications are intended to be included within the scope of this invention.

First Embodiment

A description of the first embodiment is given below with reference to the diagrams.

Figure 2:
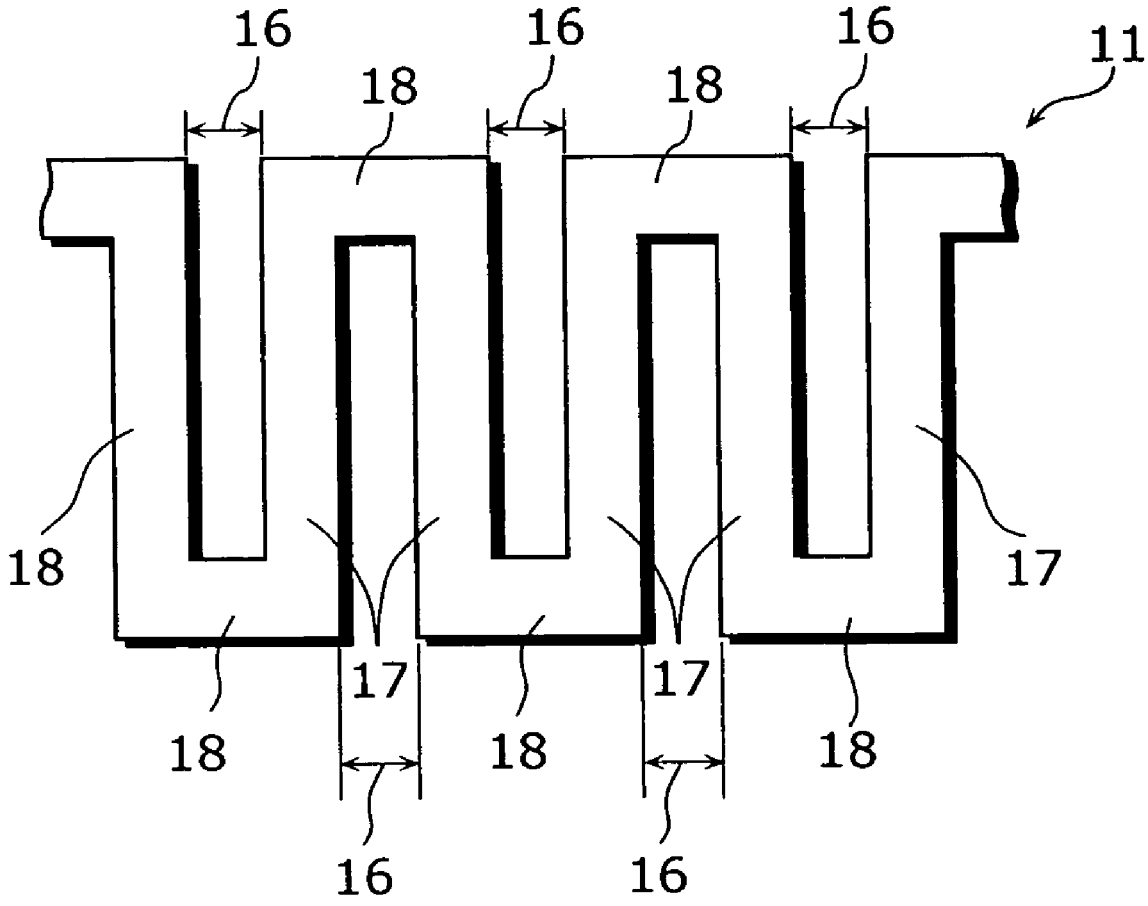
FIG. 2 is an enlarged plan view of a part of a filament in the first embodiment.
Figure 3:
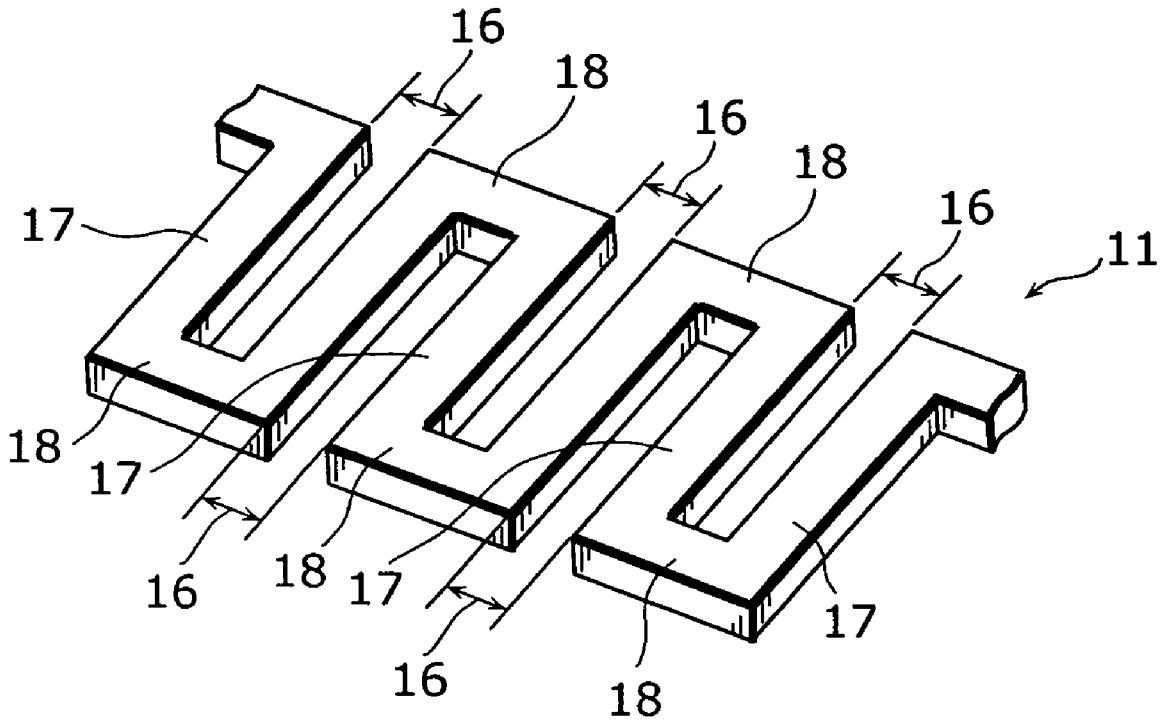
FIG. 3 is an enlarged perspective view of the part of the filament in the first embodiment.

In the present embodiment, the structure of an incandescent bulb 10, each filament space 16, and relationship between each filament space 16 and a relative proportion of a gas filled into a bulb 12. FIG. 1 is a schematic diagram of an incandescent bulb 10 in the present embodiment and a perspective view of the bulb 12 made of glass. FIG. 2 is an enlarged view of a part of a filament 11 of the present embodiment. FIG. 3 is a perspective view showing the part of the filament 11.

First, the structure of the incandescent bulb 10 is described.

As shown in FIG. 1, the incandescent bulb 10 includes the filament 11 made of a thin film, the bulb 12 provided so as to envelop the filament 11, a noble gas (not shown in the diagram) filled in the bulb 12, a base 13 provided so as to close up the opening of the bulb 12, a lead-in wire 14 which is provided in parallel to the longitudinal direction of the filament 11. The lead-in wire 14 is comprised of support wires 14*a* and 14*a* and a support wire 14*b*. Each of the support wires 14*a* and 14*a* is provided so as to connect one end of the filament 11 and one end of the bulb 12 at the side of the base 13 or the other side thereof. One end of the support wire 14*b* is provided at the base 13, while the other end thereof is provided so as to connect the end of the filament 11 and the end of the bulb 12 at the side where the base 13 is not provided.

Figure 4:
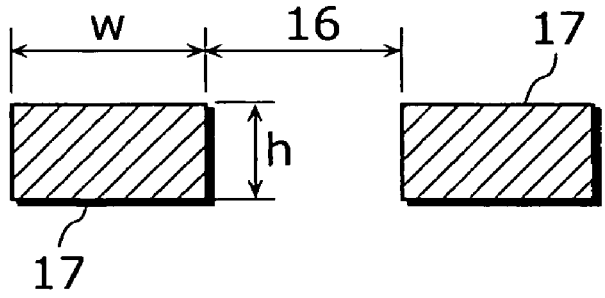
FIG. 4 is a cross-sectional view of the filament in the first embodiment.

As shown in FIG. 2 and FIG. 3, the filament 11 has a ribbon shape including spaced portions 17 which are arranged in parallel on the same plane and connecting portions 18 which are arranged on the same plane and electrically connect the spaced portions 17 in series. As shown in FIG. 4, the thickness H of each spaced portion 17 is one-half the width W thereof or more. The relationship between the width and the thickness of the connecting portion is same. More specifically, in the present embodiment, the width W and the thickness H of the spaced portion 17 are 100 μm and 50 μm respectively, which satisfy the above relationship.

The filament 11 is made of tungsten. Note that the conductive materials used for the filament are not limited to particular materials, but metallic materials having high melting points, such as tungsten, are desirable, and alloys of such metallic materials may be used.

The filament 11 has a serpentine shape having S-shaped turns on the same plane, in which the spaced portions 17 which are arranged in parallel and the connecting portions 18 which electrically connect these spaced portions 17 in series are integrated as a single unit.

The spaces between the outer edges of the adjacent spaced portions 17, namely the filament spaces 16 are equal to each other and smaller than 5 when the width of the spaced portion 17 is 1. More specifically, in the present embodiment, the filament space 16 is 100 μm, and the ratio between the width of the spaced portion 17 and the width of the space 16 is 1 to 1.

The plane which is formed by the spaced portions 17 arranged as mentioned above is the light-emitting surface of the filament 11. In other words, the filament 11 is formed on the same plane, and the surfaces of the spaced portions 17 and the connecting portions 18 on that plane are the light-emitting surfaces.

It should be noted that the above-mentioned S-shaped turns of the filament 11 on the same plane means that the entire filament 11 having a shape like a zigzag or serpentine road substantially exists on one plane. In other words, in the filament 11 having the shape like a zigzag or serpentine road, the tangential directions are various all over the surface of the filament 11, but all the tangents exist on the same plane where the filament 11 exists. The same plane does not mean the strictly mathematical plane, but it means a substantially flat surface including a little distortion, deviation or twist created during working of the filament 11 or bulb assembly. In other words, it means a substantial flat surface including a certain degree of distortion, deviation or twist that allows the heat generated by applying the current to the filament to form a sheath enveloping the filament 11 including the filament spaces 16 so as to maintain the temperature of the filament constant at an acceptable level for commercial use. The filament spaces 16 are to be described later.

Figure 11:
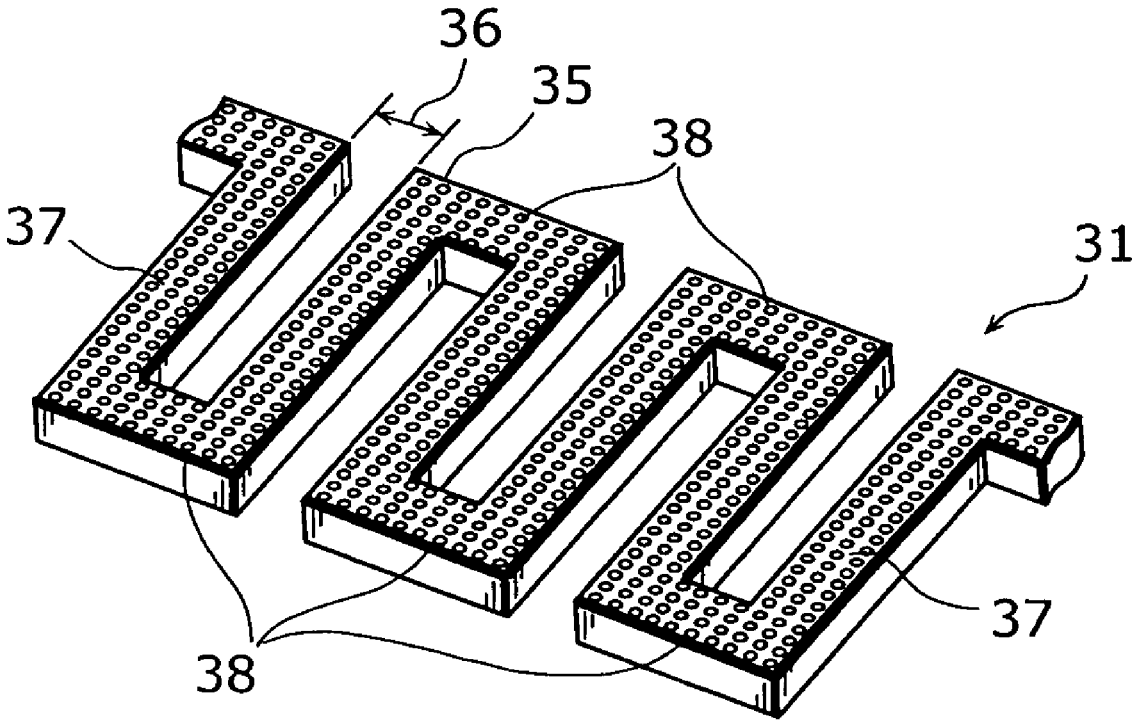
FIG. 11 is a schematic perspective view of the filament.

In the present embodiment, the filament 11 is manufactured by performing etching, which is commonly used in a manufacturing process of semiconductor devices, on a conductive tungsten sheet of ribbon shape. More specifically, the filament 11 shown in FIG. 11 is manufactured by etching a single conductive sheet of ribbon shape by patterning a zigzag shown in FIG. 2 on the ribbon and melting the unpatterned parts.

As described above, the filament is formed by etching, so the outside force does not damage the filament 11 during the manufacturing process nor reduce the strength of the turns. In addition, since etching hardly distorts the filament 11, compared with the machining and meltdown, it becomes possible to prevent the decrease of the lifetime of the filament caused by stress and therefore to attain high production accuracy.

It should be noted that this description does not deny forming of the filament 11 by machining and meltdown. The filament of the present invention, even if it is manufactured by press working, for example, also shows the same effect.

The bulb 12 is made of glass such as soda glass, hard glass and silica glass.

The gas filled in the bulb 12 consists mainly of a noble gas, and in particular, it consists of 90 percent of argon gas and 10 percent of nitrogen gas. The noble gas and the nitrogen gas are filled in the bulb 12 so that the inside of the bulb 12 is at 1 atmospheric pressure when the incandescent bulb 10 is lighted. By doing so, even if the bulb 12 is broken by mistake, it is possible to prevent the glass bulb 12 from being shattered.

The base 13 is made of brass, aluminum base alloy or the like, and is combined with the socket to connect the incandescent bulb 10 to the power supply.

The lead-in wire 14, that is, the support wires 14*a* and the support wire 14*b*, is formed by plating a copper or iron wire with nickel, and fixes the filament 11 in the inner space of the bulb 12. The support wires 14*a* and the support wire 14*b* supply the current to the filament 11. More specifically, the current supplied from the external power source connected to the filament 11 via the base 13 reaches the filament 11 through the support wires 14*a* and returns to the external power supply through the support wire 14*b*.

Next, each filament space 16 is described below.

According to the above-mentioned radiation mechanism of the incandescent bulb, if the filament space 16 is too small, discharge takes place between the adjacent spaced portions 17, which causes breaking of the filament 11. Therefore, the filament space 16 of the filament 11 according to the present embodiment offers a larger space than the space between the outer edges of the spaced portions 17 in which discharge takes place. In particular, the filament space 16 which does not cause discharge is considered to be 30 μm or larger, and the filament space 16 of the present embodiment is 100 μm.

Here, the larger space than the space between the outer edges of the spaced portions 17 which causes discharge when the incandescent bulb 10 is lighted means the space between the spaced portions 17, namely the filament space 16 of a degree to which lighting of the incandescent bulb 10 does not cause discharge between the spaced portions 17. In this case, there is no risk of discharge between the spaced portions 17, and therefore there is also no risk of breaking of the filament 11. Accordingly, the incandescent bulb 10 is lighted.

The tolerance and deformation during lighting of the lamp is considered under the condition in which the gas containing 90 percent of argon gas and 10 percent of nitrogen gas is filled in the bulb 12 at the above-mentioned pressure, it is preferable to set the filament space 16 of 40 μm or larger. The filament space 16 of 40 μm or larger not only absorbs manufacturing tolerance and deformation caused by thermal distortion but also prevents discharge between the outer edges of the spaced portions 17. Therefore, it is possible to avoid the damage or thermal deviation caused by the discharge and thus prevent the breaking of the filament 11.

In the case where the gas containing 90 percent of argon gas and 10 percent of nitrogen gas is filled in the bulb 12, discharge does not occur between the outer edges of the spaced portions 17 ideally even if the filament space 16 is smaller than 40 μm, for example, 30 μm. However, it is difficult to manufacture the filament 11 having the filament spaces 16 of precise design widths. Therefore, the filament spaces 16 of the filament 11 have a certain extent of variations in width. In other words, it is very difficult to manufacture the filament 11 so that 30 μm, that is the width in which discharge does not occur, is maintained for all the filament spaces 16. If even one of the spaces is smaller than 30 μm, that is the width in which discharge does not occur, due to the variations during manufacturing, discharge occurs in that space and the filament 1 is broken due to the above-mentioned radiation mechanism of the incandescent bulb. As a result, the lamp cannot be lighted. The filament space 16 is set to be 40 μm or larger in order to prevent such a case. In theory, discharge does not occur between the outer edges of the spaced portions 17 even if the filament space 16 is 30 μm.

Next, a description is given below of a relationship between each filament space 16 and the relative proportions of the gas filled in the bulb 12.

According to the above-mentioned radiation mechanism of the incandescent bulb, if the filament space is too small, discharge takes place between the outer edges of the spaced portions 17, the impedance of the filament decreases, overcurrent flows, and as a result, the filament temperature rises, which causes breaking of the filament 11. However, if an increased amount of nitrogen gas is filled into the bulb 12, in particular, if the pressure of the nitrogen gas is increased or the relative proportion of the nitrogen gas is increased, it is possible to prevent the discharge between the outer edges of the spaced portions 17 even if the filament space 16 is small. This is because the dielectric breakdown voltage of nitrogen gas is high. On the other hand, argon gas is added to the gas to be filled in the bulb 12 just for preventing the decrease of the lifetime of the filament due to its vaporization. Therefore, if an increased amount of argon gas is filled into the bulb 12 and the filament space 16 is reduced, discharge takes place between the outer edges of the spaced portions 17 according to the above-mentioned radiation mechanism of the incandescent bulb, which causes breaking of the filament 11. This phenomenon that the increased amount of nitrogen gas prevents discharge between the outer edges of the spaced portions 17 even if the filament space is small reflects the Paschen Law that the breakdown voltage V is represented by a function of the product pd of the distance d between electrodes and the gas pressure p. Here, the dielectric breakdown voltage V is the threshold voltage at which the gas between the electrodes is dielectrically broken down, and the breakdown voltage V of nitrogen gas is larger than that of argon gas. The distance d between the electrodes denotes the filament space 16. According to the Paschen Law, if the pressure p of nitrogen gas is increased within a range in which the dielectric breakdown voltage V is maintained unchanged, the distance d between the electrodes, namely the filament space 16 can be narrowed, in particular to narrower than 30 μm. Accordingly, it becomes possible to reduce the filament space 16 while preventing discharge between the filament strands. However, a large amount of nitrogen gas is filled into the bulb 12 by increasing the pressure of nitrogen gas too much or increasing the relative proportion of nitrogen gas too much, the lamp efficiency is down. It is impossible to fill only nitrogen gas into the bulb 12, and it is also impossible to make the filament space 16 as small as possible. Therefore, it is preferable to design the filament space 16 to be 30 μm or larger in order to have the best balance between various lamp characteristics.

On the other hand, if the filament space is too large, a sheath is not formed so as to envelop all over the surface of the filament 11 including the filament spaces 16, or even if a sheath is formed, it does not contribute the improvement of the lamp efficiency. More specifically, if the width of the filament space 16 is five times the width of the spaced portion 17 or larger, a sheath is not formed, or if a sheath is formed, it does not contribute the improvement of the lamp efficiency. It is preferable that the width of the filament space 16 is twice the width of the spaced portion 17 or less, and it is more preferable that the former is one time the latter, namely, the width of the spaced portion 17 is equal to the width of the filament space 16.

Figure 5:
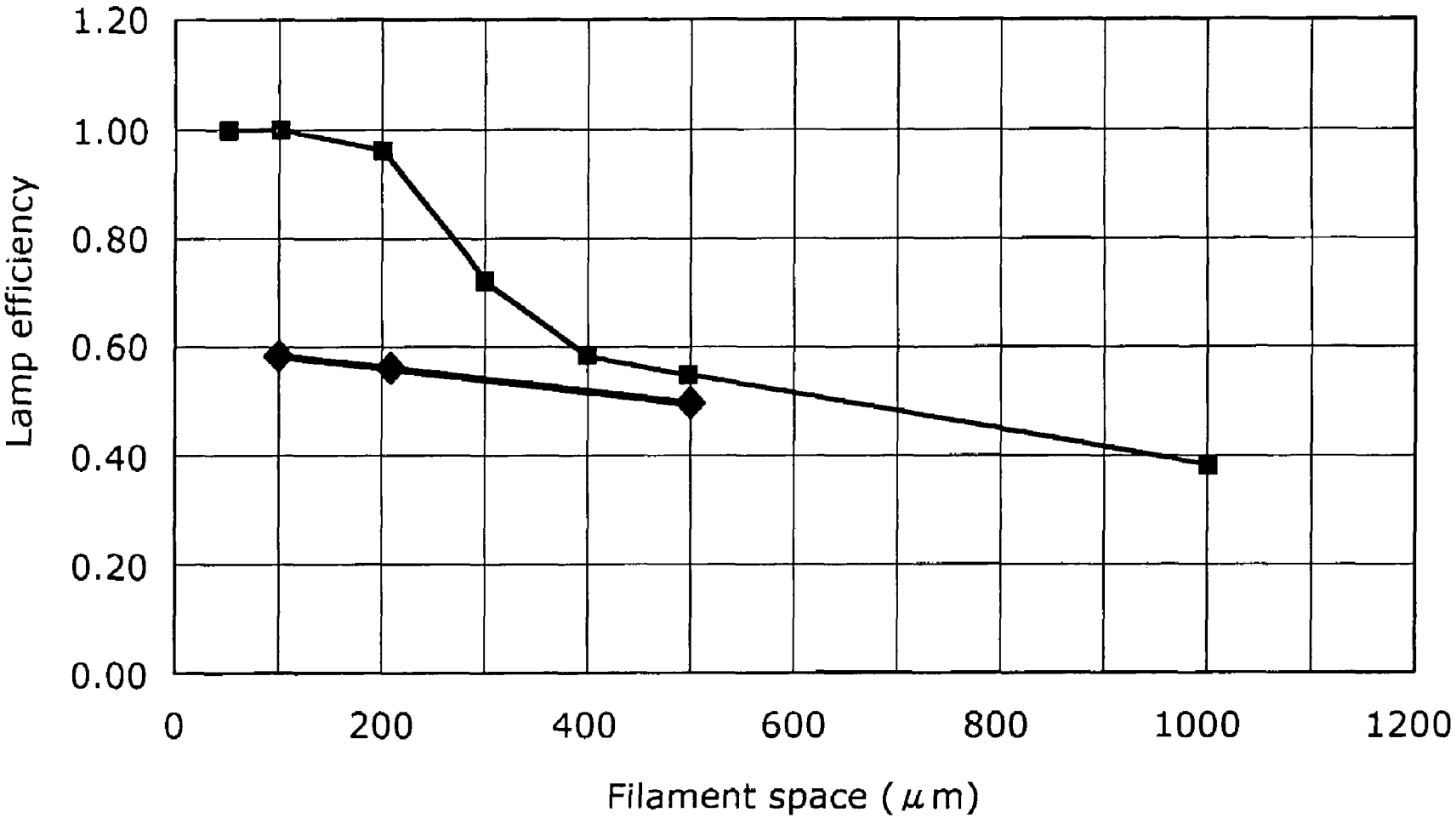
FIG. 5 is a graph showing the relationship between filament spaces and lamp efficiencies.

FIG. 5 is a graph showing the simulation results of the relationship between the filament space 16 and the lamp efficiency when the width of the spaced portion 17 is 100 μm. This is simulated based on the actual measurement values obtained by the actual experiment using a filament having the filament space 16 of 100 μm and the filament thickness of 50 μm. The graph in FIG. 5 shows the simulation results obtained based on the lamp efficiency of 1 where the filament space 16 is 100 μm and the thickness is 50 μm. Small black squares (■) show the simulation results obtained when the thickness of the filament 11 is 50 μm, while small black rhombuses (◆) show the simulation results obtained when the filament thickness is 25 μm.

This graph shows that the lamp efficiency rises dramatically when the filament space 16 becomes less than five times the width of the spaced portion 17 (when the filament space 16 is smaller than 500 μm in this graph). Dramatic improvement of the lamp efficiency can be expected if the thickness of the filament 11 is at least one half the width thereof, but such dramatic improvement cannot be expected if the thickness of the filament 11 is less than one half the width thereof. On the other hand, there is no particular upper limit of the thickness of the filament 11, in particular the thickness of the spaced portion 17, if the above-mentioned relationship is satisfied. However, considering the easiness of manufacturing and the probability of occurrence of distortion, the efficiency begins to rise if the thickness of the filament 11 is less than five times the width thereof (namely, if it is smaller than 500 μm), and the efficiency falls within a desirable range because the efficiency improvement reaches a saturation level when the thickness of the filament 11 is less than twice the width thereof (namely, when it is smaller than 200 μm). Furthermore, in the case where the filament 11 is formed by etching, the efficiency improves at a constant rate if the thickness of the filament 11 is equal to or less than the width thereof (namely, if it is smaller than 100 μm), which is a suitable size.

As described above, it is preferable that the minimum filament space 16 is 30 μm or larger in terms of discharge and 40 μm or larger in terms of manufacturing. On the other hand, it is necessary that the maximum filament space 16 is less than five times the width thereof, preferably it is twice or less, and more preferably it is equal or less.

In the present embodiment, the filament space 16 is set to be 100 μm, which falls within the above desirable range. Therefore, using the filament space 16 of the present embodiment, convection of noble gas and nitrogen gas hardly takes place around the filament 11. As a result, the radiated heat is not diffused, the temperature of the filament 11 is maintained constant because it is enveloped by a sheath, and thus high lamp efficiency is achieved.

It is preferable that the width of the filament 11 is 100 μm or larger, not because such width is required for the lamp efficiency but because it is required to ensure the mechanical strength of the filament. More specifically, if the width of the tungsten filament is smaller than 100 μm, the filament is significantly deformed due to heating during energization, and it becomes difficult to keep the predetermined filament space 16. Therefore, if the mechanical strength (particularly against the deformation by heat) of the filament is improved by the manufacturing method and filament material, it becomes possible to further reduce the width of the filament.

As described above, even if the incandescent bulb 10 including the filament 11 of the present embodiment is lighted, discharge does not occur between the outer edges of the spaced portions 17 because each filament space 16 is larger than the space which causes discharge between the outer edges of the spaced portions 17 arranged in parallel during lighting, and therefore the filament 11 is not broken. In addition, since both the filament space 16 and the width of the spaced portion 17 are 100 μm, the radiated heat is not diffused by the noble gas and nitrogen gas which exist in the filament space, and therefore the incandescent bulb 10 achieves high lamp efficiency. More specifically, the lamp efficiency of the incandescent bulb 10 including the filament 11 of the present embodiment is 15 to 16 Im/W, which is higher than that of the conventional incandescent bulb, namely, 13 to 14 Im/W.

It should be noted that Krypton gas may be filled into the bulb in order to improve lamp efficiency. Bulbs in which krypton gas is filled have been developed and other various methods and ideas have been suggested. However, there has been no disclosure of the bulb of the present embodiment having the lamp efficiency increased by about 20 percent or the method for improving the lamp efficiency by about 20 percent.

The effects of the present embodiment are described below.

Each filament space 16 in the filament 11 of the present embodiment is set to be 100 that is larger than the space which causes discharge between the outer edges of the spaced portions 17. Therefore, even if the incandescent bulb 10 including the filament 11 is turned on, electrical discharge does not take place between the outer edges of the spaced portions 17. As a result, the impedance is not reduced in the spaced portions 17 which cause the discharge, and therefore overcurrent is prevented and breaking in the filament is also prevented. This protects the incandescent bulb 10 from lighting failure.

More specifically, in the case where gas containing 90 percent of argon gas and 10 percent of nitrogen gas is filled into the bulb 12, the filament space 16 needs to be at least 30 μm, or 40 μm even if machining accuracy and heat distortion are considered. On the other hand the filament space 16 needs to be at most 500 μm because the width of the filament 11 is 100 μm. Therefore, in the present embodiment employing the filament space 16 of 100 μm, the noble gas and nitrogen gas do not cause convection. As a result, since the radiated heat is not diffused by the convection of the noble gas and nitrogen gas, the sheath remains to envelop all over the surface of the filament 11.

As described above, in the incandescent bulb 10 including the filament 11 of the present embodiment, the filament is not broken, nor is the radiated heat diffused. Therefore, the incandescent bulb 10 including the filament 11 according to the present invention has higher lamp efficiency although it emits light from the completely planar surface.

As shown in FIGS. 1, 2 and 3, the filament 11 is formed in a ribbon shape having a plurality of turns in the plane including the filament 11. The structure of the filament 11 is simple. In addition, in manufacturing the filament 11, there is no need to perform machine work such as folding a long member a number of times. It is manufactured just by etching a tungsten sheet of ribbon shape. Therefore, the filament is not damaged during manufacturing so that it can be manufactured easily and precisely.

As for the filament of the present embodiment, the spaced portions are aligned in parallel, but the present invention is not limited to such alignment. The filament spaces 16 are equal to one another, but the present invention is not limited to such equal spaces. The present invention requires a structure in which the spaced portions 17 are aligned side by side with the filament spaces 16 and the filament spaces 16 are within the range larger than the space (for example, 30 μm) which causes discharge between the opposite outer edges of the ribbon when the bulb is lighted but smaller than five times the width of the filament 11. More specifically, in the case where a gas containing 90 percent of argon gas and 10 percent of nitrogen gas is filled in the bulb 12 and the width of the filament 11 is 100 μm, the spaced portions 17 need to be aligned so that the filament spaces 16 fall within the range of 30 μm or larger but smaller than 500 μm, preferably in the range of 40 μm or larger but smaller than 300 μm, and more preferably 50 μm or larger but smaller than 200 μm, when the width of the filament 11 is 100 μm.

In the present embodiment, argon gas is used as a noble gas, but the present invention is not limited to argon gas, and krypton gas or xenon gas may be used. The use of krypton gas or xenon gas prolongs the life-span of the filament 11, compared with the use of argon gas.

Second Embodiment

A description of the second embodiment is given below with reference to the diagrams.

Figure 6:
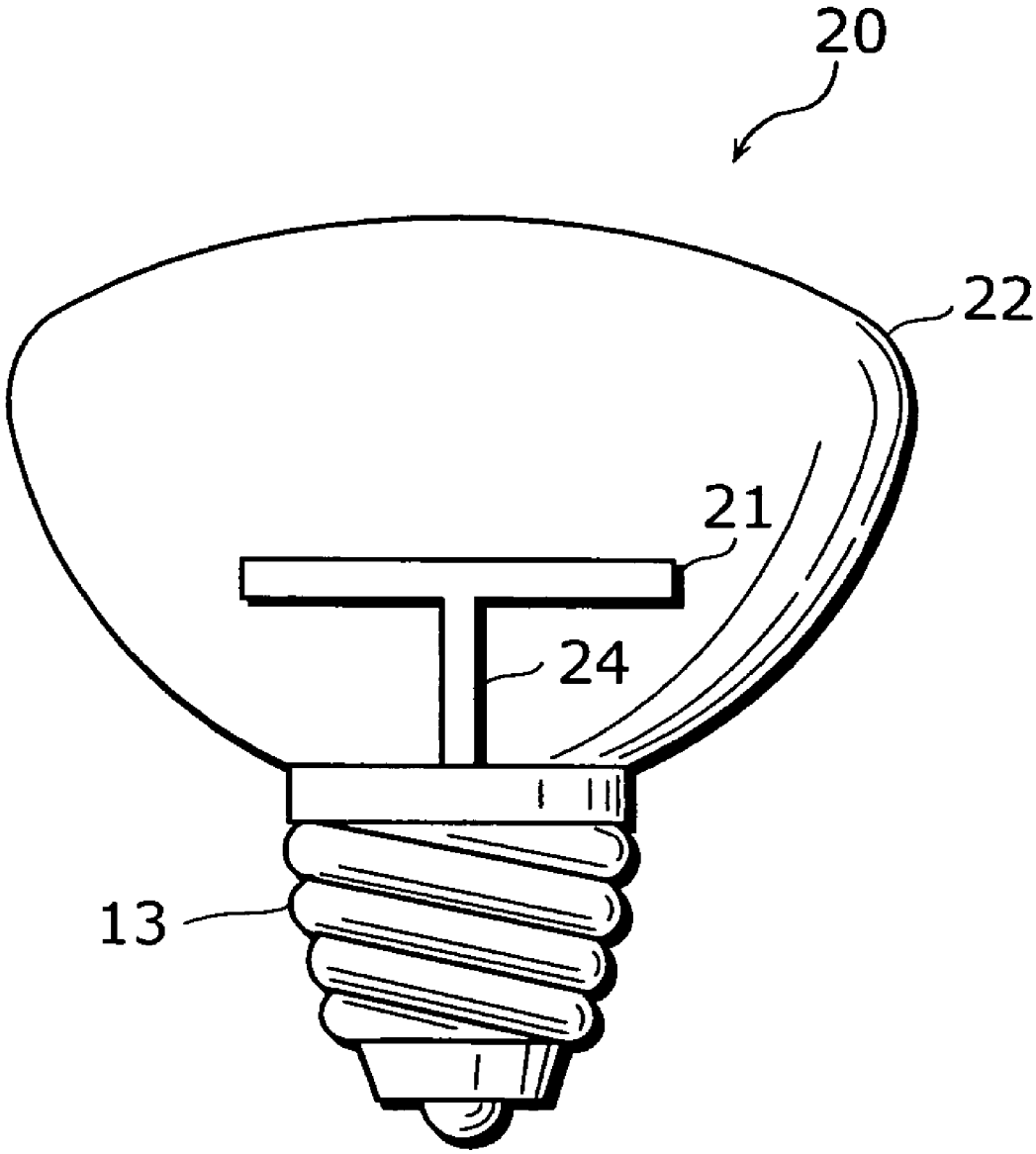
FIG. 6 is a side view of an incandescent bulb in a second embodiment.
Figure 7:
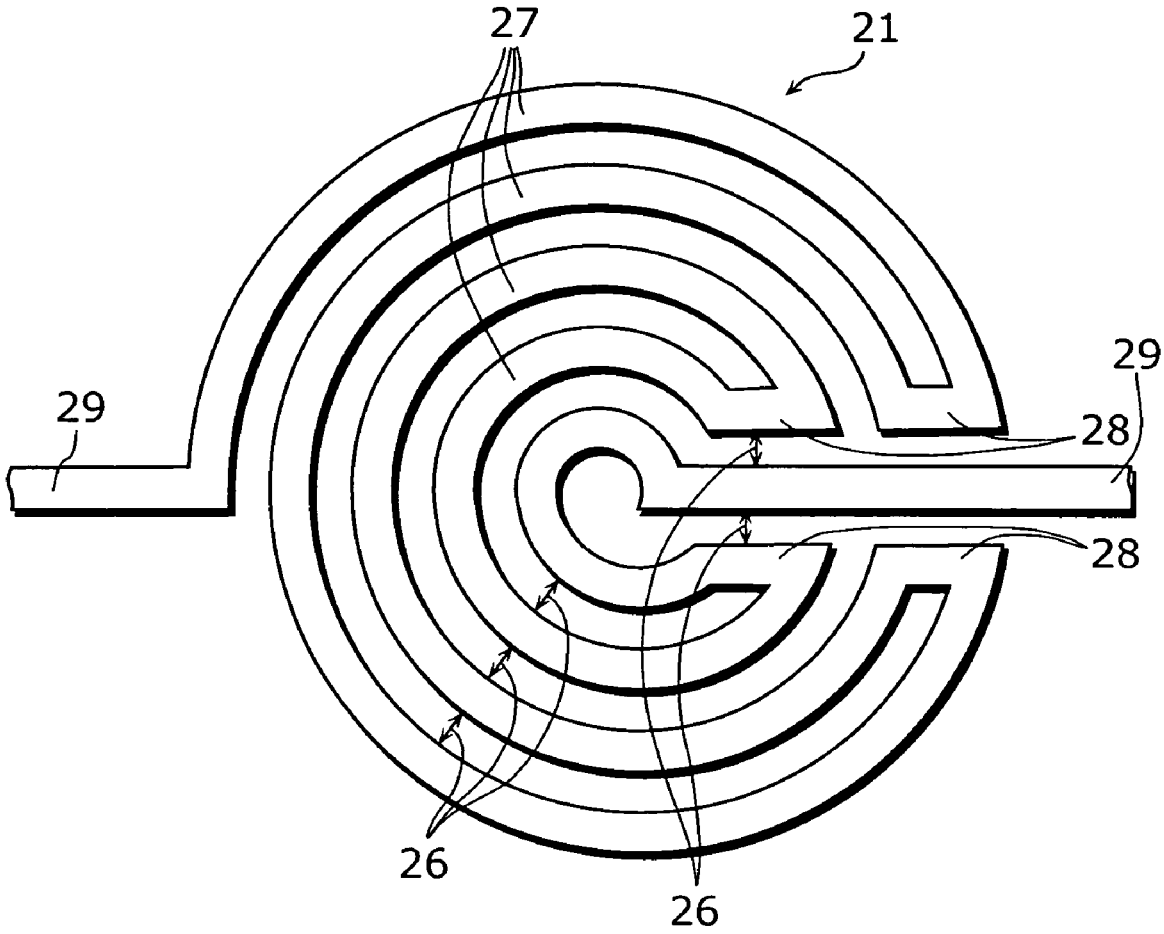
FIG. 7 is a plan view of a filament in the second embodiment.

In the present embodiment, a description is focused on the structure of an incandescent bulb 20. FIG. 6 is a schematic diagram showing a perspective view of the incandescent bulb 20 in the present embodiment when viewed through the glass that forms a bulb 22. FIG. 7 is an enlarged view of a filament 21 in the present embodiment.

Differently from the incandescent bulb 10 in the first embodiment, the incandescent bulb 20 in the present embodiment includes the filament 21 having a round shape appearance, and therefore the shapes of the bulb 22 and the lead-in wire 24 are different from those of the first embodiment. Everything else is identical to the incandescent bulb 10 and the filament 11 in the first embodiment. Therefore, a detailed description of the overlap between these embodiments is not repeated here.

As shown in FIG. 6, the incandescent bulb 20 includes the filament 21 made of a thin film, the bulb 22 which is provided so as to envelop the filament 21, a noble gas and a nitrogen gas (not shown in the diagram) filled in the bulb 22, the base 13 which is provided so as to close up the opening of the bulb 22, and the lead-in wire 24 which is provided so as to connect the base 13 and the filament 21.

As shown in FIG. 7, the filament 21 is comprised of conductive spaced portions 27 having the width of 100 μm and the thickness of 50 μm, connecting portions 28 which connect the spaced portions 27 electrically in series, and a lead-out portion 29 for connecting these spaced portions 17 and the connecting portions 28 to the outside electrically in series. The filament is made of tungsten, as is the case with the first embodiment.

The spaced portions 27 are placed concentrically with equal space on the same plane including the spaced portions 27, and the outermost spaced portion 27 encircles the inner spaced portions 27. They are electrically connected to each other in series by the connecting portions 28 so that they form a winding filament with a plurality of turns, and one end of the filament is led out of the circles of the spaced portions 27 on the same plane by the lead-out portion 29. The outermost spaced portion 27 of the filament 21 is formed so that the radius of the circle that is the outer circumference thereof falls within 1 mm. The filament spaces 26 are equal to one another. The plane on which the filament 21 structured as mentioned above exists is the light-emitting surface.

The filament space 26 is set to be 100 μm, which is same as the filament space 16 in the above first embodiment. The space between the connecting portion 28 and the lead-out portion 29 is also set to be 100 μm. In other words, the filament space 26 is larger than the space which causes discharge between the opposed spaced portions 27 and between the connecting portion 28 and the lead-out portion 29 when the bulb is lighted. Therefore, discharge never takes place between the filament strands and the filament 21 is never broken. Since the space is set to be 100 μm, a sheath is formed all over the filament 21 including the space between the outer edges of the spaced portions 27. As a result, the incandescent bulb 20 in the present embodiment has high lamp efficiency.

The relationship between the filament space 26 and the relative proportion of the gas filled in the bulb 22 is same as that between the filament space 16 and the relative proportion of the gas filled in the bulb 12 in the above first embodiment. More specifically, an increased amount of nitrogen gas filled in the bulb 22 allows suppression of discharge between the outer edges of the opposed spaced portions 27 even if the filament space 26 is small, which results in achievement of the filament space of less than 40 μm. However, considering the balance between various lamp characteristics, it is preferable to set the filament space 26 to be 40 μm or larger.

A description of the effects of the present embodiment is given below.

In addition to the effects of the incandescent bulb 10 and the filament 11 in the above first embodiment, the incandescent bulb 20 and the filament 21 in the present embodiment have the following effects. Since the filament 21 is arranged so as to encircle the round area of the equally-spaced concentric circles, it loses less heat by the convection of the gas filled in the bulb 22 than a long filament like the filament 11 in the above first embodiment. Therefore, the incandescent bulb 20 has higher lamp efficiency than the incandescent bulb 10. In addition, since the filament 21 has a round outer shape, the bulb 22 enveloping this filament 21 can also have a semiround shape like the conventional incandescent bulb, and therefore the bulb 22 can be used when the light is needed locally. In other words, the incandescent bulb 20 has an effect that it can be used locally as a spotlight. In addition, since the light-emitting portion of the filament 20 is a flat surface which is localized into one area, it is effective for a light-condensing lamp combined with a lens optical system.

As with the filament 11 in the above first embodiment, it is necessary that the opposed spaced portions 27 are arranged with the filament space 26 between them and the filament spaces 26 are, in any part of the filament, smaller than 500 μm and larger than the space which causes discharge between the outer edges of the opposed ribbon filament strands when the light is turned on. In the case where gas containing 90 percent of argon gas and 10 percent of nitrogen gas is filled into the bulb 22, the opposed spaced portions 27 need to be placed so that the widths of the filament spaces 26 fall within the range of 30 μm or larger and smaller than 500 μm.

Figure 8:
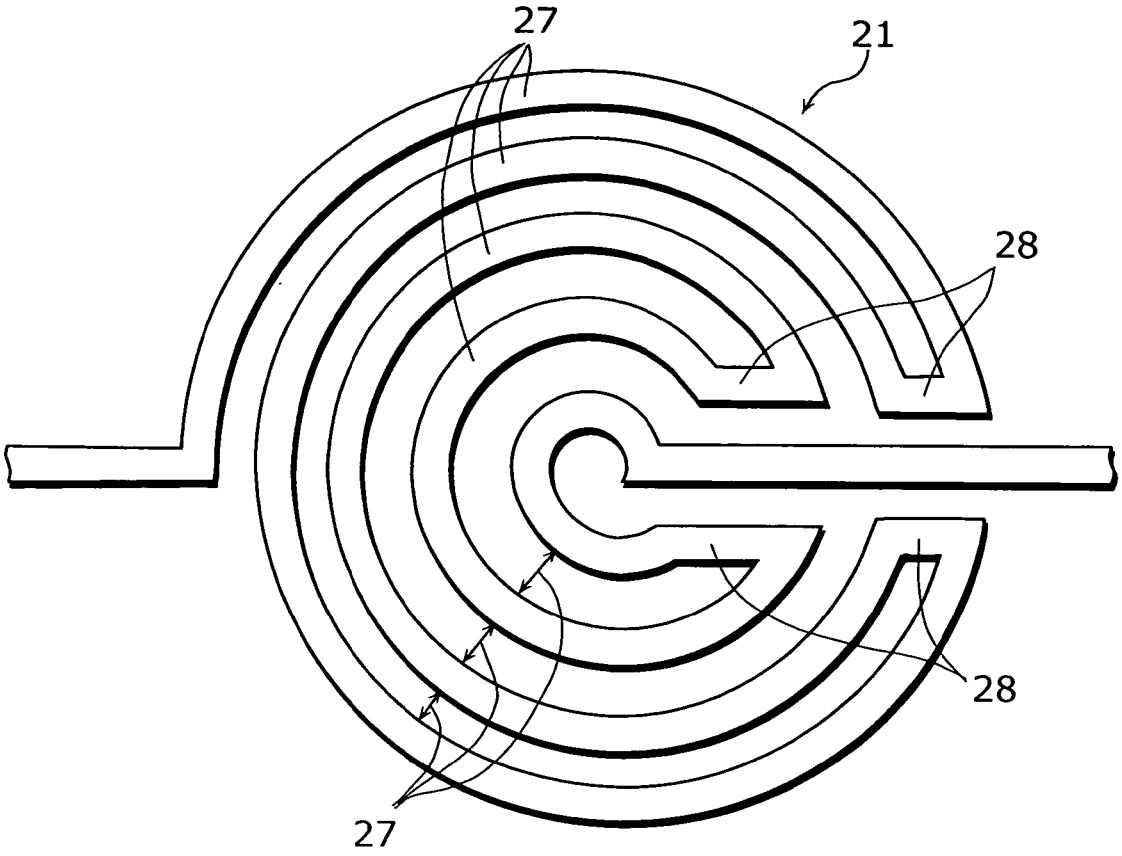
FIG. 8 is a plan view showing a modification of the filament.

In the filament of the present embodiment, the opposed spaced portions 27 are placed in parallel, but the present invention is not limited to such placement. The filament spaces 26 are equal to one another in the present embodiment, but the present invention is not limited to such equal spaces. For example, as shown in FIG. 8, it is possible that only the outermost filament space 26 is set to be 100 μm while other spaces are set to be wider toward the center of the circles. Even if the spaced portions 27 are placed in this manner, an effective sheath is formed. The overall shape of the filament 21 does not need to be round, and it may be an arbitrary shape such as a polygon like a triangle or a rectangle, an ellipse or an oval, a star, and a heart-shape.

Third Embodiment

The incandescent bulb in the present embodiment is an incandescent bulb including a filament having microcavities. Before describing the present embodiment, a description of a microcavity is given.

Patent Document 1 discloses a method for increasing selectivity of wavelengths of electromagnetic radiation from a filament, namely, for preventing infrared radiation, by forming microcavities, as a means for increasing the lamp efficiency of an incandescent bulb, on the surface of the filament that is the light-emitting surface and using a quantum effect of these microcavities. In this method, a microcavity is a square column in shape having a square bottom with a length of each side of about the wavelength of visible light and a depth longer than the wavelength of visible light (See Patent Document 1). Patent Document describes as follows. For example, if the surface of the filament has microcavities each having a square bottom with a side length of 350 nm and a depth around 7000 nm that is 20 times the length of 350 nm, it becomes possible to suppress electromagnetic waves having 700 nm or longer wavelengths from being radiated outside the filament. In other words, if the microcavities are formed on the surface of the filament, electromagnetic radiation with wavelengths longer than twice the length of the side of each microcavity is blocked, while only electromagnetic radiation with wavelengths shorter than twice the length of the side of the microcavity is radiated outside the filament. Therefore, it becomes possible to prevent infrared radiation using a microcavity having a side length of about one half the absorption spectrum wavelength of visible light, which results in improvement in lamp efficiency.

There are two methods for forming microcavities on the surface of the filament that is a light-emitting surface: a method using a laser beam; and a method using an anodized oxide film. In the method using a laser beam, a laser beam is irradiated to a mask having a plurality of holes. Next, a mask image created by the laser beam that passed through the mask is focused onto the filament surface using an optical system, and the filament to which the laser beam is irradiated is scrapped off. As a result, a plurality of microcavities (that is an array of microcavities) are formed on the filament surface. On the other hand, in the method using an anodized oxide film, first an anodized oxide film having microcavities is provided on the surface of a base material metal. Next, a metal film that is a replica is formed on the surface of the base material metal so as to fill these microcavities using CVD method or the like. Then, the base material metal and the anodized oxide film are removed. As a result, the convex-concave shapes corresponding to the microcavities of the anodized oxide film are printed on the surface of the replica metal layer. Then, a conductive thin film (commonly made of tungsten) that turns into a filament is formed on the surface of the replica metal layer using CVD method or the like, and the replica metal layer is removed. As a result, the microcavities formed on the anodized oxide film is printed on the surface of the conductive thin film that forms a filament, and thus an array of microcavities is formed on the filament surface.

However, in the method using a laser beam, the filament surface on which microcavities are formed must be flat in order to focus the image of a pattern of holes on the filament surface precisely using the laser beam divided by the holes formed on the mask. In the method using an anodized oxide film, the filament surface on which microcavities are formed must be flat in order to form a conductive thin film on the surface of the replica metal layer using CVD method or the like. Therefore, it is very difficult to form microcavities on the light-emitting surface of a coil filament made of a wire because the surface is not flat.

In contrast, the surface of the light-emitting element 50' described in Patent Document 2 is made from a series of elements 52a to 52k, and the surfaces of these elements 52a to 52k are flat.

Therefore, the light-emitting surface of the light-emitting element 50' is also flat, which allows forming of microcavities on that surface.

Here, in order to manufacture a 24 V and 100 W type bulb, it is necessary to use a wire of 0.2 mm in diameter and 30 cm in length for a common coil filament wire, and a wire of 300 μm in width, 100 μm in thickness and 30 cm in length for the filament 50 disclosed in Patent Document 2. The filament 50 disclosed in Patent Document 2, even if it is not so large, has the same power as that of the coil filament. Therefore, it is inferred that a bulb having higher lamp efficiency than a coil filament can be provided if microcavities are formed on the light-emitting surface of the light-emitting element 50'.

However, in order to form microcavities on the light-emitting surface of the filament 50 disclosed in Patent Document 2, the above-mentioned processes need to be carried out 2000 times for the filament 50 of 300 μm in width, 100 μm in thickness and 30 cm in length because a mask having a side length of 300 μm is used in the method using a laser beam, which takes a lot of trouble and time. In the method using an anodized oxide film, a CVD chamber for processing a 30 cm or longer conductive thin film is needed. Therefore, it is difficult to form microcavities on the light-emitting surface of the light-emitting element 50' using the current CVD chamber. In either case, it is difficult to perform microcavity forming process on the light-emitting surface of the light-emitting element 50' although it is flat, and thus it is impossible to improve the lamp efficiency of the bulb including the light-emitting element 50'.

Furthermore, even if a technique for forming microcavities on a large light-emitting surface of a filament is developed and microcavities can be formed on the light-emitting surface of the light-emitting element 50' without difficulty, the spaces 53*a* to 53I and the spaces 55 between the elements of the light-emitting element 50', namely 500 μm, are very large. Therefore, a noble gas causes convection between the elements, which causes losses of a part of the heat produced on the light-emitting element 50'. As a result, the sheath formed around the light-emitting element 50' is separated in the spaces 53*a* to 53I and 55, that is, the sheath is not formed so as to envelop all over the light-emitting element 50'. As described above, even if microcavities are formed on the surface of the light-emitting element 50', the bulb including such a filament does not have higher lamp efficiency.

Figure 9:
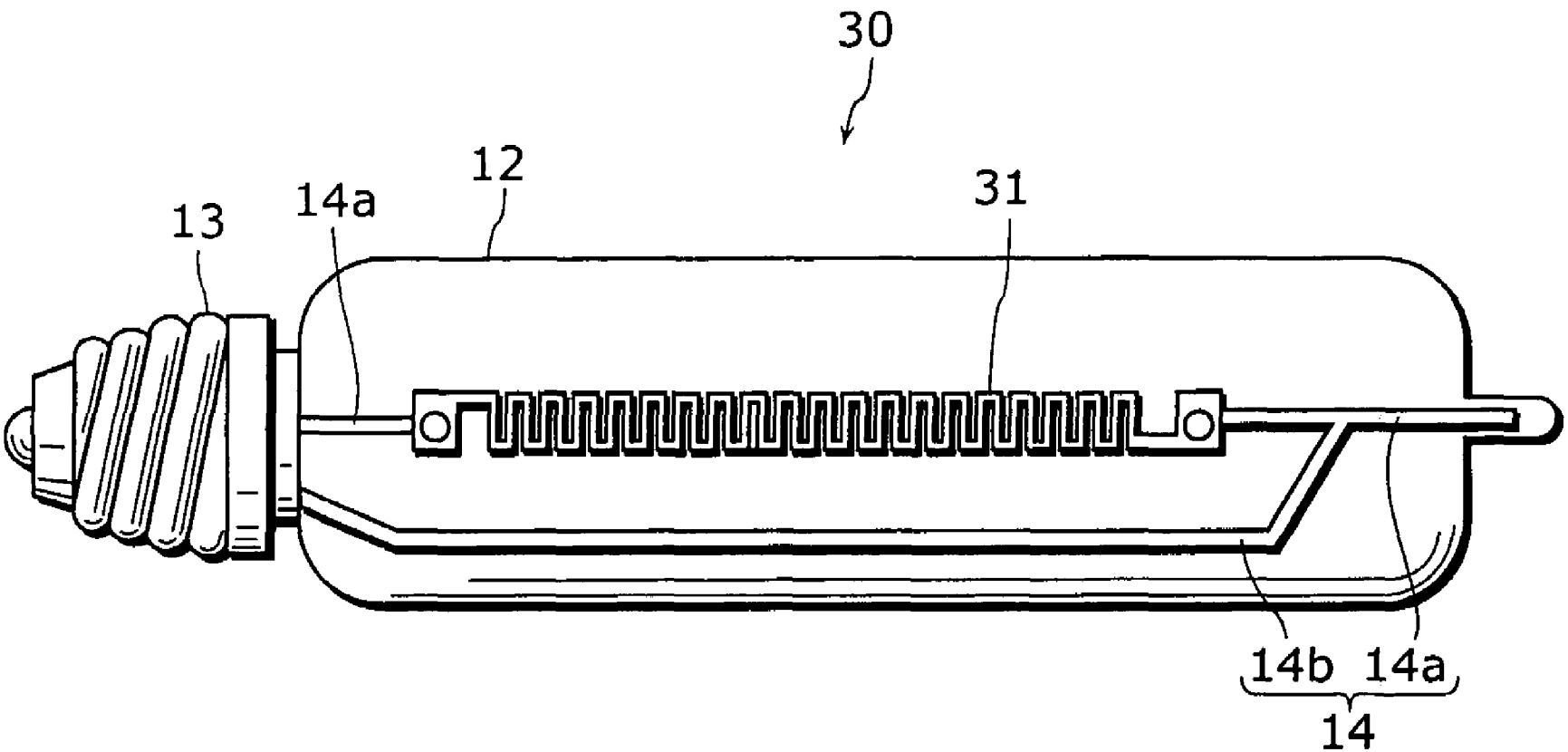
FIG. 9 is a side view of an incandescent bulb in a third embodiment.
Figure 10:
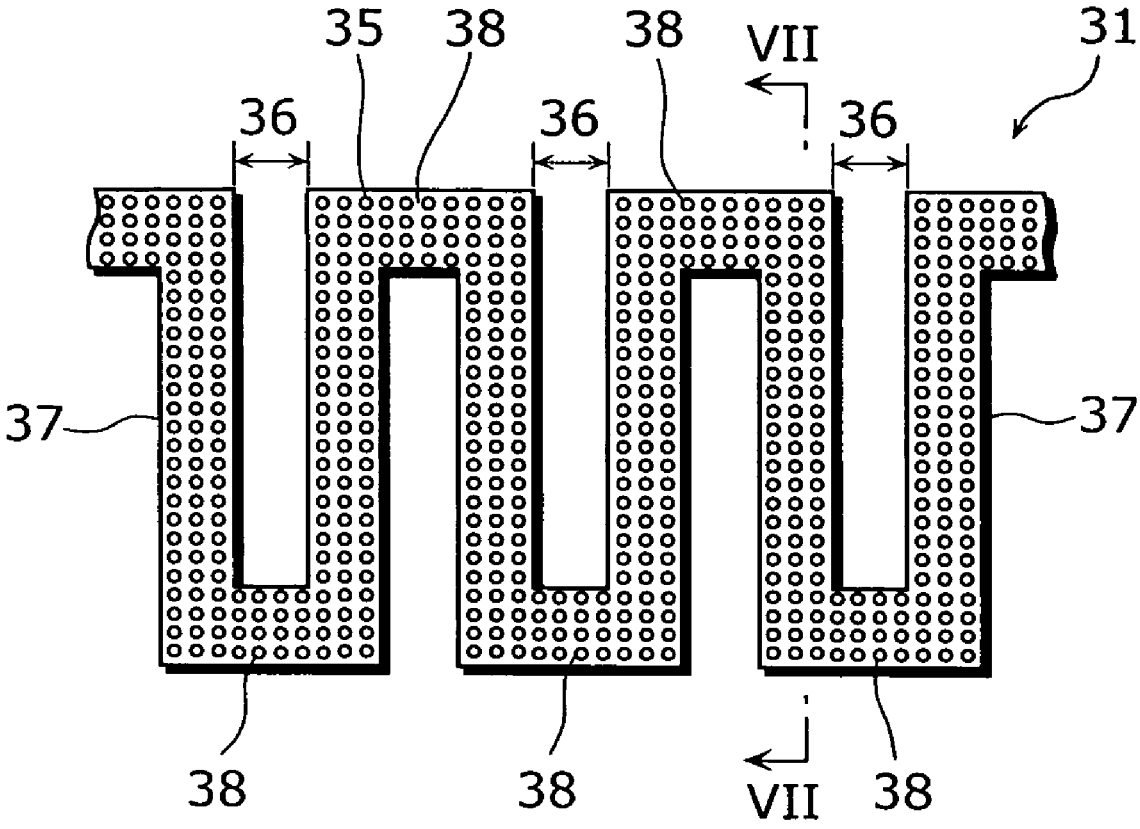
FIG. 10 is a plan view schematically showing a filament having microcavities.
Figure 12:
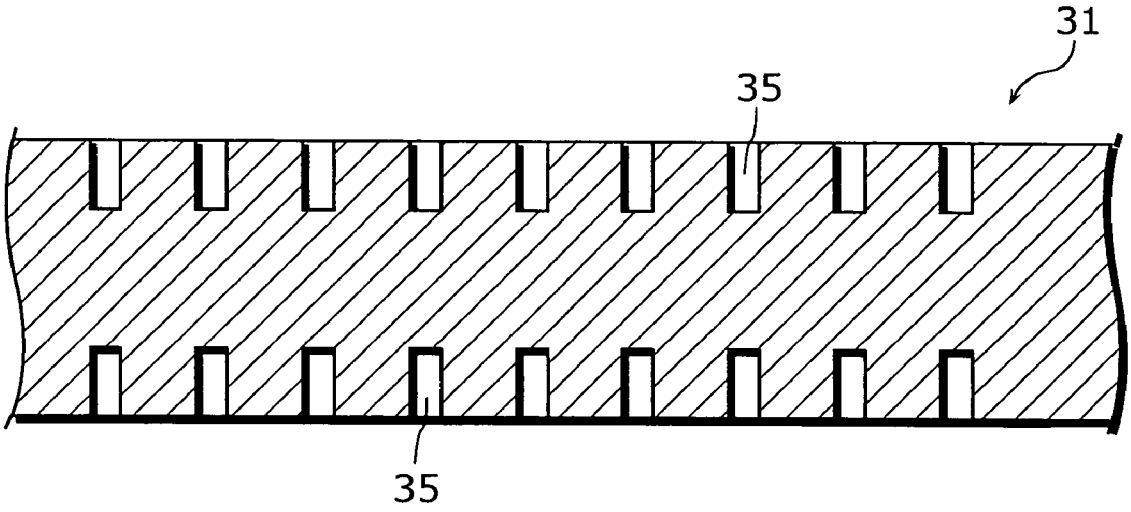
FIG. 12 is an enlarged view of a part of the cross portion VII—VII in FIG. 10.

In the present embodiment, a description is given, with reference to the diagrams, of a method for forming a filament 31 having microcavities on its surface and such microcavities. FIG. 9 is a schematic diagram of an incandescent bulb 30 in the present embodiment and a perspective view of the bulb 12 made of glass. FIGS. 10 and 11 are enlarged views of the filament 31 of the present embodiment. For easy understanding, the microcavities 35 are shown on the filament 31 in the diagrams, but the actual microcavities are very small relatively to the filament 31. FIG. 12 is an enlarged view of a part of the cross portion VII—VII in FIG. 10.

It should be noted that it is possible to form microcavities on any filament of the present invention and to produce their effects. For example, it is possible to apply these microcavities to the concentrically arranged filament shown in FIG. 7 and FIG. 8. The same effects are also obtained when microcavities are formed on this filament.

Differently from the incandescent bulb 10 in the above first embodiment, in the incandescent bulb 30 of the present embodiment shown in FIG. 9, microcavities are formed on the surface of the filament 31, but there is no difference between FIG. 9 and FIG. 1 because the microcavities 35 are too small to be shown in the diagram. Therefore, a detailed description of the overlap between these embodiments is not repeated here.

The incandescent bulb 30 includes the filament 31 made of a thin film, the bulb 12 provided so as to envelop the filament 31, a noble gas and a nitrogen gas (not shown in the diagram) filled in the bulb 12, the base 13 provided so as to close up the opening of the bulb 12, the lead-in wire 14 which is provided in parallel to the longitudinal direction of the filament 11.

As shown in FIG. 9, the filament 31 is a 100-μm-wide and 50-μm-thick ribbon made of tungsten. As shown in FIG. 9, the filament 31 has a shape having a plurality of S-shaped turns on the same plane in which spaced portions 37 which are arranged in parallel and connecting portions 38 which electrically connect these spaced portions 37 in series are integrated as a single unit. As shown in the sectional view of FIG. 12, a plurality of microcavities 35 are formed on the surface of the filament 31. Here, a microcavity denotes a very small hole, and has a cylindrical shape in the present embodiment. The depth of each microcavity needs to be twice the diameter of the opening or larger. When the microcavities 35 are formed on the surface of the filament 31, radiation of electromagnetic waves having wavelengths of twice the opening diameter of the microcavity 35 or longer is blocked, while only electromagnetic waves having wavelengths shorter than twice the opening diameter of the microcavity 35 are radiated outside. Therefore, using the microcavity 35 having the opening diameter of about one half the wavelengths of visible light, specifically the opening diameter of the range between 350 nm and 400 nm inclusive, infrared radiation can be blocked, which results in higher lamp efficiency. Although this microcavity has a cylindrical shape, it may have a rectangular column shape. In this case, it is preferable that the side length is in the range between 350 nm and 400 nm inclusive.

As a method for forming the microcavities 35, the conventional method using a laser beam or an anodized oxide film can be applied. In the method using a laser beam, the microcavities 35 can be formed while manufacturing a filament by etching, so it is very easy to form the microcavities 35 on the surface of the filament 31. It is possible to form the microcavities 35 by etching, and it is also possible to form the microcavities 35 at the same time while the filament is formed by etching.

In the present embodiment, the filament space 36 may be smaller than 40 μm if an increased amount of nitrogen gas is filled into the bulb 12. However, the filament space 36 of 40 μm or larger is preferable in view of the balance between various lamp characteristics. As just described, there is no difference between the shape of the filament 31 itself and that of the above-mentioned filament.

The effects of the present embodiment are as follows.

The filament 31 in the present embodiment has the following effect in addition to the effects of the above first embodiment. To be more specific, since the microcavities 35 are formed on the surface of the filament 31, the incandescent bulb 30 in the present embodiment has still higher lamp efficiency than the incandescent bulb 10 in the above first embodiment.

EXAMPLE

The following three types of bulbs were prepared: an incandescent bulb having the same structure as the incandescent bulb 10 of the-above first embodiment (hereinafter referred to as a "bulb A"); a 60 W silica bulb including a double-coil filament made of a tungsten wire (Product number L100V57W) (hereinafter referred to as a "bulb B"); and a bulb including a filament of a simple rectangular tungsten sheet (hereinafter referred to as a "bulb C"). Here, the filament included in the bulb A has a thickness of 50 μm, a width of 100 μm, a length of 20 nm and a filament space is 10 μm. The filament included in the bulb C is a tungsten sheet of ribbon shape having a thickness of 50 μm, a width of 10 μm and a length of 20 nm. The filament included in the bulb C has a straight shape without turns. At least a noble gas is filled in each of the bulbs A, B and C so that the atmospheric pressure inside the bulb becomes 1 when the bulb is lighted.

This example shows the comparison results of the lamp efficiencies of these three bulbs A, B and C and the analysis results of the temperature distribution in the direction of the length of the filament included in each bulb.

First, the three bulbs A, B and C were lighted so that the distribution temperature of each filament becomes 2800 K, and their lamp efficiencies were compared. Table 1 shows the comparison results.

TABLE 1

| | Bulb | | |
|---|---|---|---|
| | A | B | C |
| Lamp efficiency (1 m/W) | 15–16 | 13–14 | 8–9 |

Table 1 shows that the bulb A has the highest lamp efficiency.

The above results show that the bulb A has higher lamp efficiency values by 10 percent to 20 percent than the existing bulb (bulb B) and therefore has higher industrial applicability than the existing bulb (bulb B). They also show that a bulb with high lamp efficiency can be made very easily because the lamp efficiency values increase by 10 percent to 20 percent without forming microcavities on the filament surface.

Figure 13:
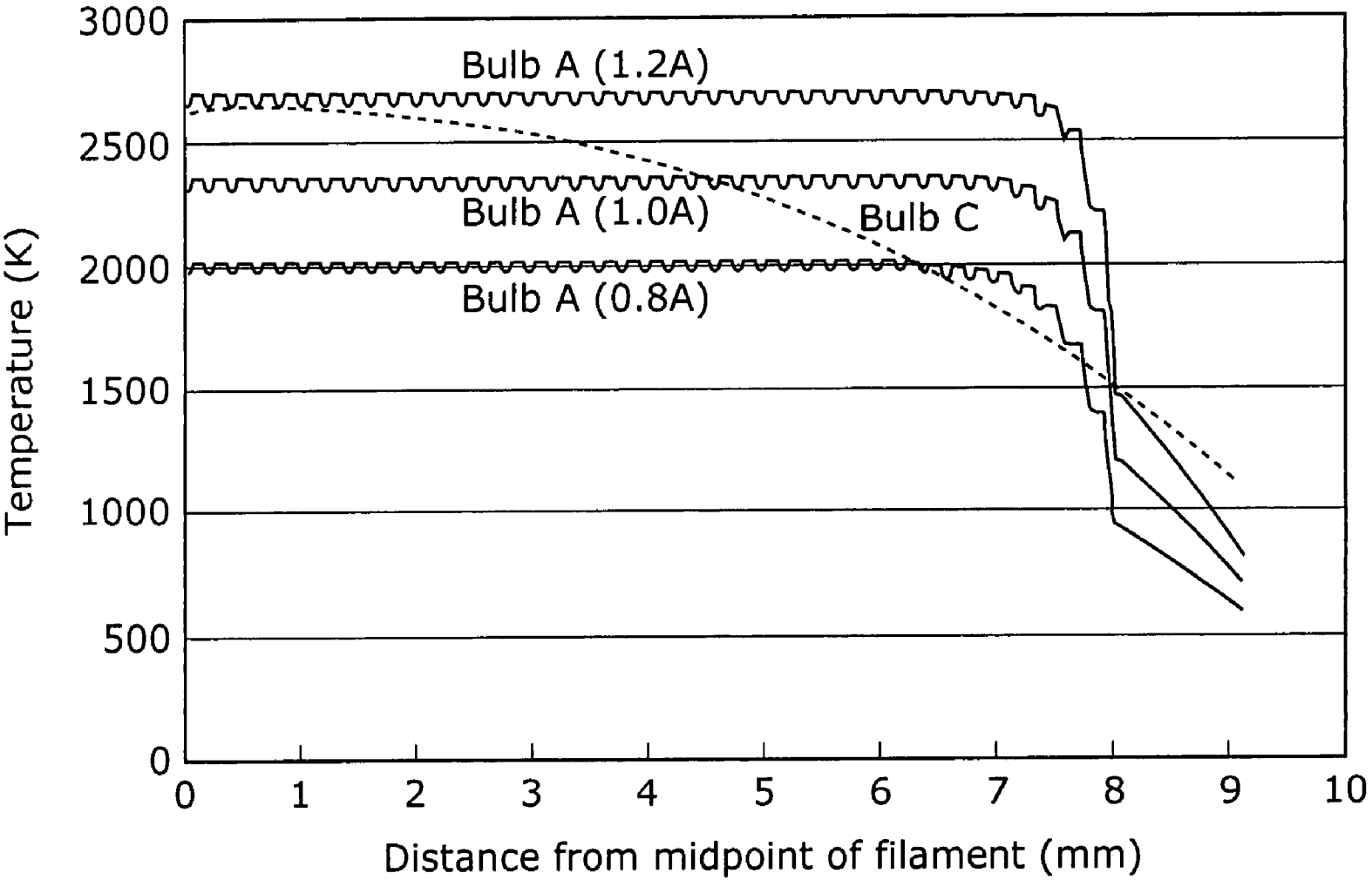
FIG. 13 is a graph showing heat analysis results.

Next, the thermal analysis simulation (CD-adapco Japan, Star CD ver. 3. 150) was performed on the bulbs A and C so as to examine the temperature distribution in the direction of the length of the filament of each bulb. Here, the currents of 0.8 A, 1.0 A and 1.2 A are applied to the bulb A. FIG. 13 shows the results. The horizontal axis of the graph in FIG. 13 shows the distance from the midpoint of the filament in its length direction to each junction between the filament and the lead-in wire, while the vertical axis shows the temperature at each point. The solid lines show the results of the thermal analyses obtained when the currents of 0.8 A, 1.0 A and 1.2 A are applied to the bulb A, while the broken line shows the result of the thermal analysis of the bulb C.

FIG. 13 shows that the temperature is almost constant from the midpoint of the filament to each junction between the filament and the lead-in wire in the case where the currents of 0.8 A, 1.0 A and 1.2 A are applied to the bulb A (which are respectively shown by solid lines). It is considered that periodic reduction in temperature in the graph indicates the temperature change of the noble gas that exists in the filament space. In contrast, the temperature of the bulb C (shown by a broken line) reduces monotonously from the midpoint of the filament to each junction between the filament and the lead-in wire.

According to the above results, it can be said that the heat emitted from the filament of the bulb C is diffused by the convection of the noble gas and nitrogen gas filled in the bulb, which results in failure to form a sheath which envelops all over the filament surface of the bulb C. In contrast, the heat emitted from the filament of the bulb A is not diffused by the convection of the noble gas and nitrogen gas filled in the bulb, which results in forming of a sheath which envelops all over the filament surface of the bulb A. Therefore, the bulb A has the higher lamp efficiency than the bulb C. In other words, the temperature can be maintained constant in a filament like the filament of the bulb A having a plurality of turns so as to have the filament space of 100 μm because a sheath is formed all over the filament surface, and an incandescent bulb including such a filament, namely the bulb A, has high lamp efficiency.

INDUSTRIAL APPLICABILITY

As described above, the incandescent bulb according to the present invention is applicable as a bulb which emits white light when the current is applied to the filament of the incandescent bulb, and particularly as an electric bulb for lighting or the like. The incandescent bulb filament according to the present invention is applicable as a filament for use in an incandescent bulb which emits white light when the current is applied, and particularly as a filament for use in an electric bulb for lighting or the like. The incandescent bulb filament according to the present invention is also applicable as a substrate filament for surface treating such as forming of microcavities.

What is claimed is:

1. An incandescent bulb filament of ribbon shape which is placed on one plane, comprising:

spaced portions which are placed side by side with spaces; and connecting portions which connect said spaced portions electrically in series, wherein each of said spaced portions has a thickness that is one half a width of said spaced portion or more, and a space between at least one pair of adjacent spaced portions is less than five times the width of said spaced portion.

2. The incandescent bulb filament according to claim 1, wherein a space between at least one pair of adjacent spaced portions is twice the width of said spaced portion or less.

3. The incandescent bulb filament according to claim 2, wherein a space between at least one pair of adjacent spaced portions is equal to the width of said spaced portion or less.

4. An incandescent bulb comprising an incandescent bulb filament according to claim 3.

5. An incandescent bulb comprising an incandescent bulb filament according to claim 2.

6. The incandescent bulb filament according to claim 1, wherein the width of said spaced portion is 100 μm or larger.

7. An incandescent bulb comprising an incandescent bulb filament according to claim 6.

8. The incandescent bulb filament according to claim 1, wherein microcavities are formed on a surface of said filament.

9. The incandescent bulb filament according to claim 8, wherein a space between an outermost spaced portion and a spaced portion adjacent to the outermost spaced portion is less than five times a width of the outermost spaced portion.

10. An incandescent bulb comprising an incandescent bulb filament according to claim 9.

11. An incandescent bulb comprising an incandescent bulb filament according to claim 8.

12. The incandescent bulb filament according to claim 1, wherein a first spaced portion is placed so as to encircle a second spaced portion.

13. An incandescent bulb comprising an incandescent bulb filament according to claim 12.

14. An incandescent bulb comprising an incandescent bulb filament according to claim 1.

* * * * *